US007251974B2

(12) United States Patent
Massee

(10) Patent No.: US 7,251,974 B2
(45) Date of Patent: Aug. 7, 2007

(54) METHOD AND FORMING MACHINE FOR DEFORMING A HOLLOW WORKPIECE

(76) Inventor: Johan Massee, Vijfsprongweg 104, 6741 JC, Lunteren (NL)

( * ) Notice: Subject to any disclaimer, the term of this patent is extended or adjusted under 35 U.S.C. 154(b) by 0 days.

(21) Appl. No.: 10/333,505

(22) PCT Filed: Jul. 20, 2001

(86) PCT No.: PCT/NL01/00563

§ 371 (c)(1),
(2), (4) Date: Jan. 20, 2003

(87) PCT Pub. No.: WO02/07906

PCT Pub. Date: Jan. 31, 2002

(65) Prior Publication Data

US 2003/0167815 A1 Sep. 11, 2003

(30) Foreign Application Priority Data

Jul. 21, 2000 (NL) ..... 1015773

(51) Int. Cl.
*B21D 22/00* (2006.01)

(52) U.S. Cl. ..... 72/84; 72/101; 72/105; 72/120; 72/125

(58) Field of Classification Search ..... 72/82, 72/84, 86, 94, 95, 101, 110, 111, 119, 120, 72/121, 124, 125, 105
See application file for complete search history.

(56) References Cited

U.S. PATENT DOCUMENTS

| | | | | |
|---|---|---|---|---|
| 1,297,819 | A | 3/1919 | Ferrier | |
| 1,500,261 | A | 7/1924 | Page | |
| 2,358,307 | A | 9/1944 | Dewey | 80/13 |
| 3,055,414 | A * | 9/1962 | Boldrini | 72/101 |

(Continued)

FOREIGN PATENT DOCUMENTS

| | | | |
|---|---|---|---|
| DE | 1024046 | * | 2/1958 |

(Continued)

OTHER PUBLICATIONS

U.S. Appl. No. 10/333,503, filed Jan. 20, 2003.

(Continued)

*Primary Examiner*—Ed Tolan
(74) *Attorney, Agent, or Firm*—Steven M. Koehler; Westman, Champlin & Kelly, P.A.

(57) ABSTRACT

The invention relates to a method and a forming apparatus for deforming a hollow workpiece having at least one open end, wherein the workpiece is clamped down in a clamping device, a first forming tool is placed into contact with the outer surface of the workpiece, said workpiece and said tool are rotated about an axis of rotation relative to each other and said workpiece is deformed by means of said first tool. A second forming tool is placed into the cavity defined by the workpiece and into contact with the inner surface of the hollow workpiece, after which the workpiece is deformed by means of said second tool.

20 Claims, 10 Drawing Sheets

U.S. PATENT DOCUMENTS

| | | | | | |
|---|---|---|---|---|---|
| 3,299,680 | A | | 1/1967 | Thompson | 72/6 |
| 3,340,713 | A | | 9/1967 | Webb | 72/83 |
| 3,380,275 | A | | 4/1968 | McGraw | 72/121 |
| 3,533,259 | A | | 10/1970 | Marcovitch | 72/110 |
| 3,738,139 | A | * | 6/1973 | Proops et al. | 72/69 |
| 3,754,424 | A | * | 8/1973 | Costanzo | 72/105 |
| 3,851,515 | A | | 12/1974 | Hautau | 72/121 |
| 3,874,209 | A | | 4/1975 | Maiorino | 72/91 |
| 4,061,009 | A | | 12/1977 | Kaporovich et al. | 72/69 |
| 4,091,648 | A | | 5/1978 | McCaslin | 72/121 |
| 4,143,535 | A | * | 3/1979 | Bouman | 72/119 |
| 4,297,926 | A | | 11/1981 | Russ et al. | 82/9 |
| 4,445,352 | A | * | 5/1984 | Pols | 72/101 |
| 4,563,887 | A | | 1/1986 | Bressan et al. | 72/84 |
| 4,838,064 | A | | 6/1989 | Pass | 72/84 |
| 5,372,028 | A | | 12/1994 | Brilman et al. | 72/117 |
| 5,408,906 | A | | 4/1995 | Gleason | 82/106 |
| 5,419,223 | A | | 5/1995 | Kubler et al. | 82/118 |
| 5,570,603 | A | | 11/1996 | Chatterley et al. | 72/101 |
| 5,571,541 | A | | 11/1996 | Ochsebnbein et al. | 425/393 |
| 5,596,897 | A | * | 1/1997 | Payne et al. | 72/84 |
| 5,758,532 | A | | 6/1998 | Massee | 72/83 |
| 5,827,161 | A | * | 10/1998 | Petit | 493/102 |
| 5,901,595 | A | | 5/1999 | Massee | 72/81 |
| 5,937,516 | A | | 8/1999 | De Sousa et al. | 29/890 |
| 5,996,386 | A | | 12/1999 | Pazzaglia | 72/84 |
| 6,018,972 | A | | 2/2000 | Irie | 72/121 |
| 6,055,836 | A | * | 5/2000 | Waterworth et al. | 72/110 |
| 6,067,833 | A | | 5/2000 | Irie | 72/121 |
| 6,216,512 | B1 | * | 4/2001 | Irie | 72/121 |
| 6,233,933 | B1 | | 5/2001 | Petty | 60/584 |
| 6,386,010 | B1 | | 5/2002 | Irie et al. | 72/84 |

FOREIGN PATENT DOCUMENTS

| | | | | |
|---|---|---|---|---|
| DE | 3019723 | * | 12/1981 | |
| DE | 4218092 C1 | | 6/1993 | |
| DE | 10013801 | * | 10/2001 | |
| EP | 0125720 | | 11/1984 | |
| EP | 0 916 426 A1 | | 5/1999 | |
| EP | 0 916 428 A2 | | 5/1999 | |
| FR | 1004843 | * | 4/1952 | |
| JP | 57-134217 | * | 8/1982 | 72/105 |
| JP | 57-202930 | * | 12/1982 | |
| JP | 60261608 | | 12/1985 | |
| JP | 62-167956 | | 7/1987 | |
| JP | 63-309333 | * | 12/1988 | |
| JP | 4115803 | | 4/1992 | |
| JP | 10076401 | | 3/1998 | |
| JP | 10151501 | | 6/1998 | |
| PL | 157062 B | | 4/1992 | |
| WO | WO 02/062500 | | 8/2002 | |

OTHER PUBLICATIONS

U.S. Appl. No. 10/333,502, filed Jan. 20, 2003.
EPO Opposition Communications for 0916428.
EPO Opposition Communications for 0916426.

* cited by examiner

METHOD AND FORMING MACHINE FOR DEFORMING A HOLLOW WORKPIECE

CROSS-REFERENCE TO RELATED APPLICATION

The present application is a national stage filing and claims priority of International patent application Serial No. PCT/NL01/00563, filed Jul. 20, 2001, and published in English the content of which is hereby incorporated by reference in its entirety.

BACKGROUND OF THE INVENTION

The invention relates to a method for deforming a hollow workpiece having at least one open end, such as a metal cylinder, for example, wherein the workpiece is clamped down in a clamping device, a first forming tool is placed into contact with the outer surface of the workpiece, the workpiece and the tool are rotated about an axis of rotation relative to each other and the workpiece is deformed by means of said first tool. A method and forming machine of this kind are known for example from European patent application No. EP 0 916 428. Said publication discloses a method and a forming machine, comprising a forming head fitted with a number of rollers, by means of which the diameter of one end of a cylindrical metal element is reduced and moreover bent through an angle.

To this end, the metal cylinder is clamped down and said cylinder and said forming head are rotated relative to each other about an axis of rotation, whereupon said end is deformed by pressing said rollers in a radial direction against the outer surface of said cylinder and moving them along said outer surface in a number of cycles, whereby the radial distance between the rollers and the axis of rotation is decreased with each cycle, as a result of which a reduction of the diameter is obtained. Since the axis of rotation is at an angle with the central axis of the metal cylinder, the end of the cylinder is not only reduced as a result of the movement in radial direction of the rollers, but in addition said end will also be positioned at an angle. Due to the use of the aforesaid cycles, the workpiece assumes the shape of the final product step by step.

EP 0 916 426 discloses a comparable method and forming machine, wherein the axis of rotation is eccentrically offset from the central axis of the metal cylinder. Thus a product is obtained wherein the central axis of the deformed portion is likewise offset from the central axis of the undeformed portion of the metal cylinder.

The method and apparatus in hand can be used, for example, in the production of the housings of catalytic converters that form part of the exhaust system of vehicles, such as passenger cars. Such catalytic converters have a diameter which is larger than the diameter of the pipes of the exhaust system of which they form part, and they are preferably positioned close to the engine block in order to reach their operating temperature as quickly as possible after the engine has been started and to maintain that temperature as much as possible. One consequence of this is that, first of all, the diameter of the connections on either side of the catalytic converter housing must be reduced in order to properly connect to the rest of the exhaust system and that in addition they often need to have a complicated shape in order to enable an optimum position with respect to the engine block.

Prior art methods and apparatuses for producing workpieces having at least one deformed end, such as e.g. the above-described catalytic converter housings, appear to provide insufficient freedom as regards to shaping. Moreover, it is necessary to use relatively thick-walled workpieces, since a heavy load is exerted on the material during the deformation process, which may lead to folds, cracks and/or an irregular distribution of the wall thickness of the final product. As a result, the obtained products, such as e.g. the aforesaid catalytic converter housings, are often heavier than is necessary for their proper functioning in an exhaust system.

SUMMARY OF THE INVENTION

It is an object of the present invention to eliminate one, some or all of the above drawbacks or at least to alleviate them to a significant extent.

In order to accomplish that objective, the method as referred to in the first paragraph includes a second forming tool that is placed into the cavity defined by the workpiece and into contact with the inner surface of the hollow workpiece, and the workpiece is deformed by means of said second tool. The forming machine according to another embodiment of the present invention includes at least one second forming tool, and possibly a driver for rotating said second tool, which second tool can be introduced into the workpiece and placed into contact with the inner wall of the workpiece in such a manner that said wall can be deformed in an outward direction, i.e. in a direction away from the cavity defined by the workpiece.

The use of the second forming tool, such as preferably one or more forming rollers, provides greater freedom as regards to product design and it makes it possible to deform the workpiece in such a manner that the deformed portions extend outside the diameter of the original workpiece, which is not possible with the method and apparatus according to the above-described prior art. If the workpiece is a metal cylinder, this means that after deformation, the deformed end(s) will lie partially or entirely outside the circumference of the undeformed part of the metal cylinder.

Moreover, the load that is exerted on the workpiece during the deformation process can be considerably reduced, so that it will be possible to form workpieces having a relatively small wall thickness as well. A minimum wall thickness of the cylindrical starting material of 1.5 mm is frequently used for the aforesaid housings for catalytic converters, while the invention makes it possible to deform materials having a smaller wall thickness of, for example, 1.2 mm or less.

Complex shapes can be obtained by pivoting the clamping device on the one hand and the tools on the other hand relative to each other about at least one axis during said deformation and/or between deforming steps (on the same workpiece). Pivoting about two or more axes, wherein at least two of said axes, or the projections of each of said axes on a common plane, are at an angle (for example of 90°) with respect to each other, makes it possible to produce complex shapes in various directions.

The invention furthermore relates to a hollow workpiece having a continuous wall and at least one open end, which has been deformed, preferably by means of the above-described method, wherein at least part of the edge of said end lies outside the circumference of the workpiece after deformation. Such a workpiece preferably comprises a substantially cylindrical or oval metal body or at any rate a body which can be deformed by means of the present method, having two open ends which have been deformed in such a manner that at least part of the edge of at least one of the two ends lies outside the circumference of an undeformed portion of the workpiece, wherein the projections of the central axes of said ends on a plane straight through an undeformed part of the metal body are at an angle of less than 180° with respect to each other.

In addition to this, the invention relates to a catalytic converter for a vehicle, such as e.g. a car, comprising such a workpiece.

For the sake of completeness, it is noted that Japanese patent application no. 08-224625 describes the manner in which the diameter of the neck of a can is reduced by means of forming rollers while a detainer is present in the can. Said detainer only functions to support the inner surface of the neck of the can, it is not used for deforming said neck.

The invention will now be explained in more detail with reference to the appended figures, which show a number of embodiments of the method and the apparatus according to the present invention.

DETAILED DESCRIPTION OF ILLUSTRATIVE EMBODIMENTS

Parts corresponding to each other or having substantially the same function in the various embodiments will be indicated by the same numerals.

Figure 1:
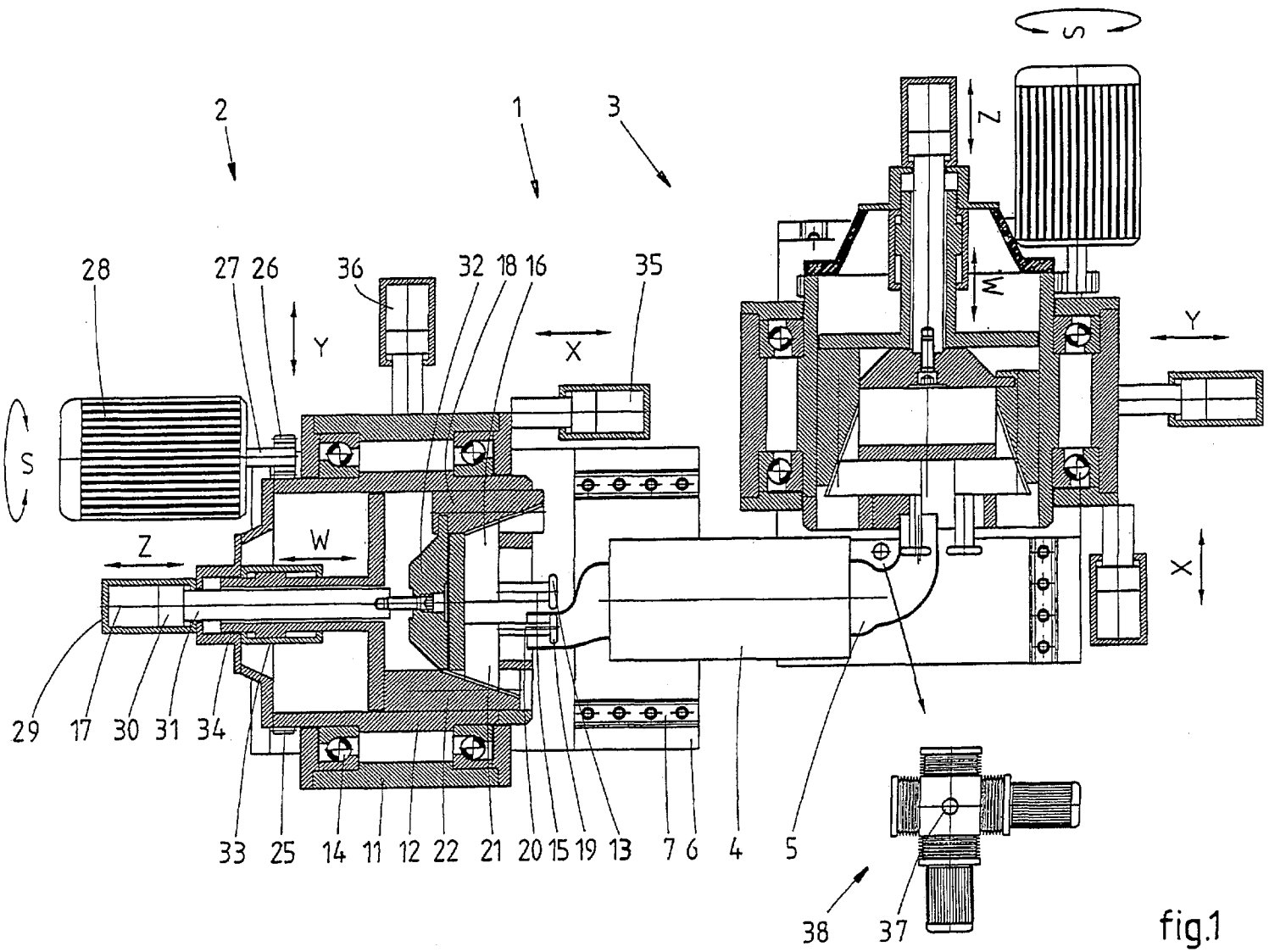
FIG. 1 is a schematic top plan view, partially in section, of a forming machine according to the present invention, comprising two forming heads and a stationary workpiece.

FIG. 1 shows a forming machine 1, comprising a first forming head 2, a second forming head 3 and a chuck 4 for clamping down the workpiece, for example the illustrated, already deformed, metal cylinder 5. The two forming heads 2, 3 comprise a baseplate 6 on which two guide rails 7 are mounted. Guides 8 extend over said rails 7 on which guides a second set of guide rails 9 is mounted, which guide rails extend at right angles to said first rails 7. Present on said second set of rails are guides 10, which support a housing 11, in which an assembly 12, comprising forming rollers 13 and means for moving said forming rollers 13, is mounted in bearings 14.

Each of the forming rollers 13 is rotatably mounted on one end of a rod 15, which is in turn mounted on or forms part of a wedge-shaped element 16, which widens in the direction of forming rollers 13. Forming rollers 13 and their respective rods 15 and wedge-shaped elements 16 can each be moved radially inwards and outwards relative to the axis of rotation 17 of assembly 12. To this end, each of the wedge-shaped elements 16 is mounted on a wedge-shaped guiding mandrel 18, whose thickness decreases linearly in the direction of forming rollers 13, in such a manner that wedge-shaped elements 16, and thus rods 15 and rollers 13, are forced radially towards axis of rotation 17 upon outward movement (to the right in the drawing) of mandrels 18, and radially away from axis of rotation 17 upon inward movement (to the left in the drawing) thereof.

In accordance with the invention, assembly 12 furthermore comprises a forming roller 19 (hereinafter called inside roller 19), which is mounted in assembly 13 in substantially the same manner as forming rollers 13, i.e. rotatably mounted on one end of a rod 20, which is in turn mounted on or forms part of a wedge-shaped element 21, which widens in the direction of forming inside roller 19. The element 21 is mounted on a wedge-shaped mandrel 22, in such a manner that the element 21, and thus rod 20 and roller 19 are forced radially towards the axis of rotation 17 upon outward movement of mandrel 22 and radially away from axis of rotation 17 upon inward movement thereof.

In FIG. 1, inside roller 19 has been moved into workpiece 5 and has been placed into contact with the inner wall of workpiece 5. The wall of workpiece 5 can be deformed in outward direction, that is, in radial direction away from the cavity 5 defined by workpiece 5, by means of said inside roller 19. Forming rollers 13 and inside roller 19 often lie in the same plane, which plane extends perpendicularly to axis of rotation 17 in this embodiment, so that the wall is confined between said rollers 13, 19 at the location of the deformation.

Assembly 12 comprises an external gear 25 on a side remote from rollers 13, 19, which gear mates with a pinion 26 mounted on the end of a drive shaft 27 of an electric motor 28. Thus, the assembly 12 can be rotated by means of a driver, herein an electric motor 28, gear 25 and pinion 26.

Assembly 12 furthermore comprises an actuator herein a hydraulic cylinder 29, which is capable of moving ring 18, and thus forming rollers 13, in radial direction by means of a piston 30, a piston rod 31 and a pressure plate 32. Within the framework of the present description, the radial movement of the forming rollers 13 will be indicated as the Z-direction.

Ring 22, and thus inside roller 19, can be moved in radial direction by means of an actuator, herein a hydraulic cylinder 33 and a hollow piston rod 34, while housing 11 can be moved along said guide rails 7 and 9 in its entirety by means of actuators, herein hydraulic cylinders 35 and 36. Within the framework of the present description, the radial movement of inside roller 19 will be indicated as the W-direction. Movements of housing 11 parallel to axis of rotation 17 and perpendicularly to said axis 17 will be indicated as the X-direction and the Y-direction, respectively.

Second forming head 3 is practically identical to forming head 2, but it is furthermore capable of pivoting movement about a pivot point 37, so that the end of workpiece 5 that is being worked by said forming head 3 can be deformed through an angle of 90°, for example. In addition, an assembly 38 is provided, by means of which axis 37 can be moved, as will be explained in more detail hereafter.

Figure 4:
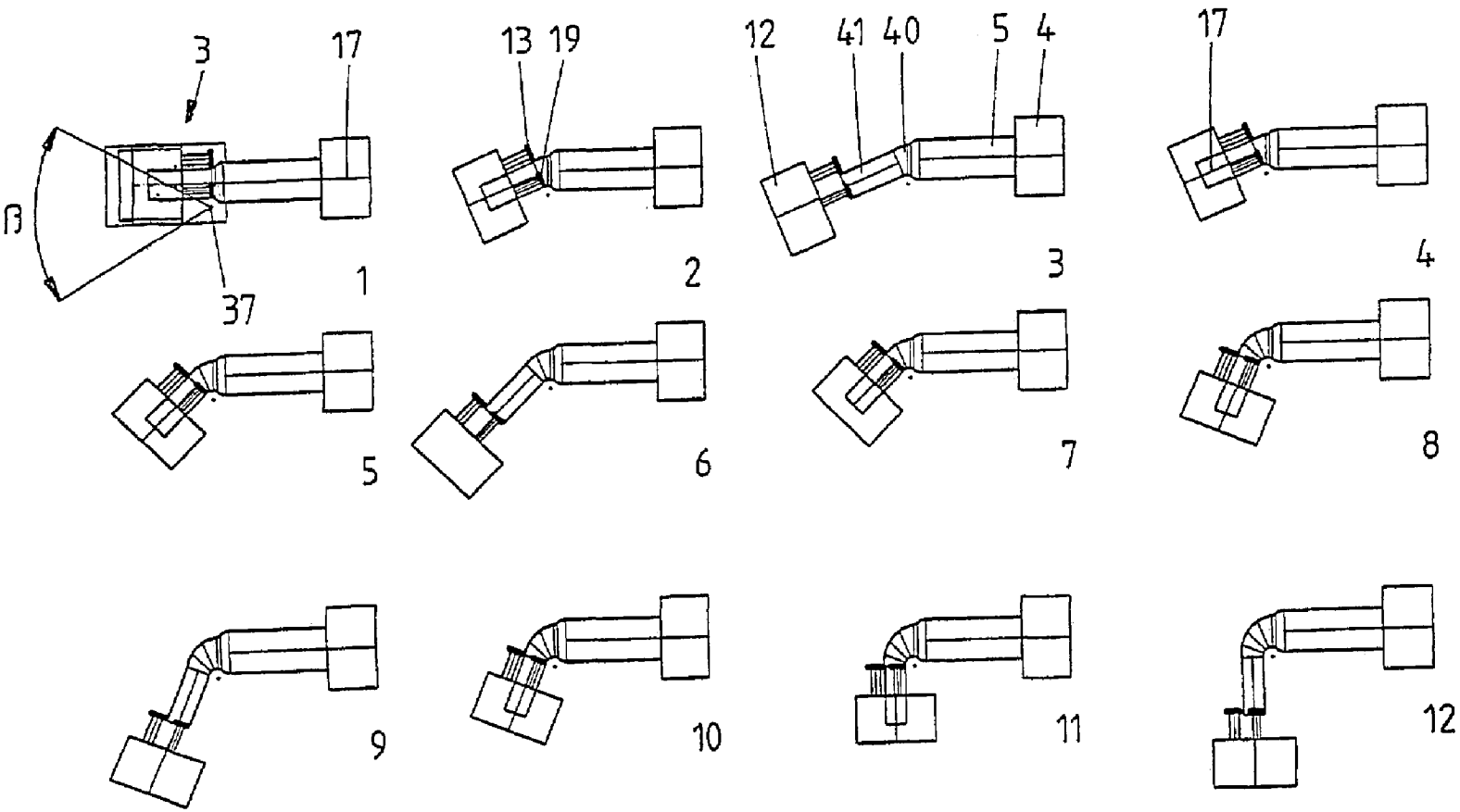
FIGS. 4 and 5 schematically show a number of stages of a method according to the present invention, carried out on the forming machine of FIG. 1.
Figure 5:
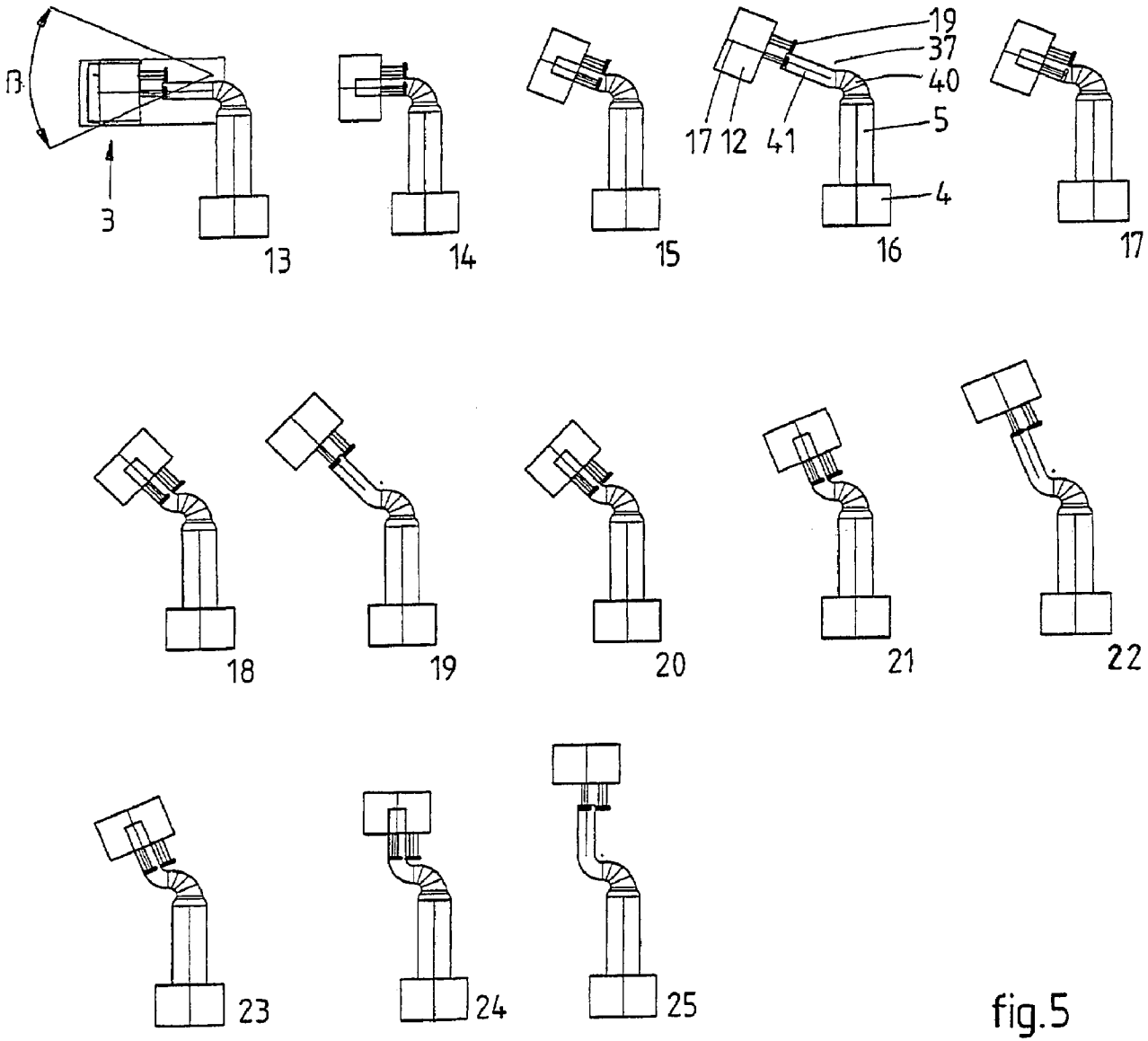

FIGS. 4 and 5 schematically show in 25 steps the manner in which an open end of a metal cylinder 5 can be deformed by means of forming head 3 of forming machine 1 according to FIG. 1. At the same time, the other end of cylinder 5 can be worked by means of forming head 2. Step 1 shows the starting position, wherein workpiece 5 is clamped down in a chuck 4. Said end, which has already undergone a machining step and which has a smaller diameter than the other part of cylinder 5, is then (step 2) deformed by rotating assembly 12 and placing the forming rollers 13, 19 into contact with, respectively, the outer surface and the inner surface of cylinder 5 and moving said rollers radially towards axis of rotation 17 and away from axis of rotation 17, respectively, and simultaneously pivoting the forming head through an angle β about pivot point 37. The various driving means are thereby controlled in such a manner that a composite, flowing movement of the forming rollers 13, 19 (in Z-direction and W-direction), assembly 13 (in X-direction and Y-direction) and the forming head (through an angle β) is obtained, as a result of which a bent portion 40 is formed.

After forming head 3 has been pivoted through an angle β, the movement of the assembly 12 in the X-direction is continued (step 3), so that a cylindrical portion 41 remains, which portion has a smaller diameter than the original open end of cylinder 5 and which extends at an angle β relative to the other part of cylinder 5.

Then (step 4) the forming rollers 13, 19 are moved radially outwards and radially inwards, respectively, so that the contact between said rollers 13, 19 and, respectively, the outer surface and the inner surface of the wall of cylinder 5 is broken. Assembly 12 is moved back along cylindrical portion 41 in the X-direction and the Y-direction until the transition between the bent portion 40 and said cylindrical portion 41.

The above cycle is repeated by pivoting forming head 3 through an angle β and translating and adjusting assembly 12 (step 5, which is substantially identical to step 2) and translating assembly 12 in the X-direction and the Y-direction (step 6, which is substantially identical to step 3), wherein the diameter of the cylindrical portion 41 is further reduced. Then the contact between said rollers and said cylindrical portion 41 is broken, and the assembly is returned to the transition area between bent portion 40 and cylindrical portion 41 (step 7, which is substantially identical to step 4).

Depending on the characteristics of the workpiece, such as the wall thickness, the mechanical strength and stiffness and the elastic elongation, steps 2-4 are repeated until the desired reduction of the diameter and the desired angle, for example of 90°, have been obtained. If the nature of the workpiece involves that the angle β must not be larger than, for example, 15 or 8 per cycle, a total number of, respectively, 6 and 12 cycles will be required for the said deformation.

After the operations that are shown in FIG. 4 have been carried out, pivot point 37 is moved by means of assembly 38 to the starting position as shown in FIG. 5 (step 13). The operation of FIG. 4 (steps 2-12) are repeated (steps 14-25), wherein the angle β is of opposite sense, however, so that an S-bend is obtained in the end of cylinder 5.

Figure 3:
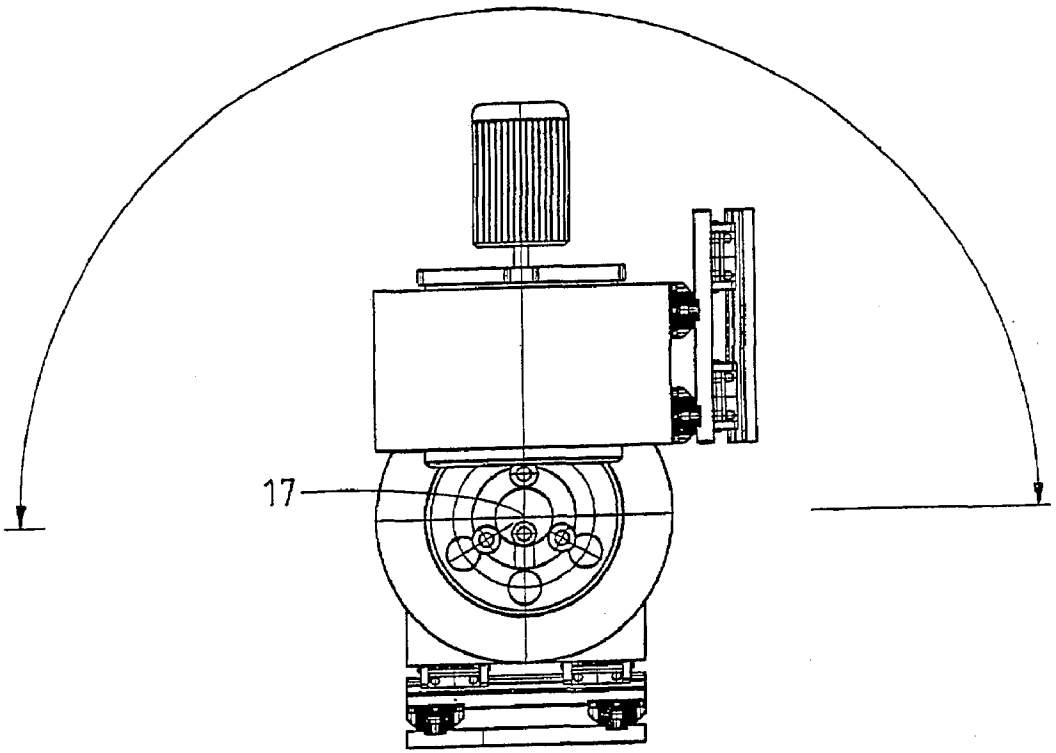
FIG. 3 is a side elevation of the forming machine of FIG. 1, wherein a part of the forming machine is turned through an angle of 90°.
Figure 2:
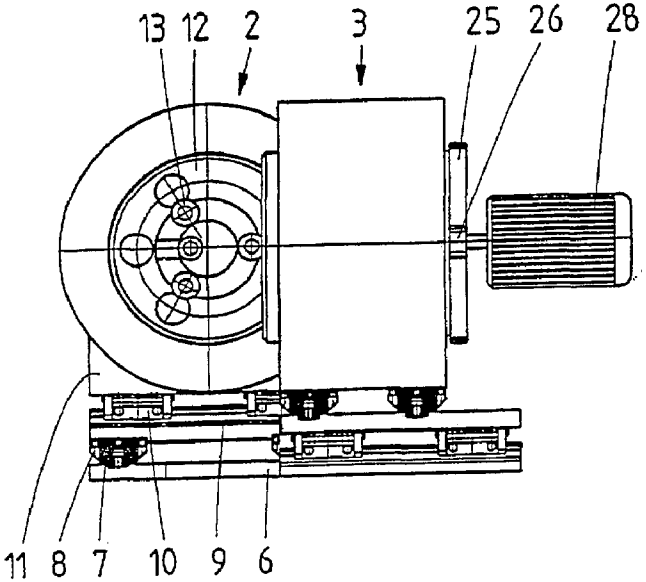
FIG. 2 is a side elevation of the forming machine of FIG. 1.

As is shown in FIG. 3, the forming head 3 of forming machine 1 is furthermore capable of pivoting movement about axis of rotation 17 of forming head 2, so that the bending of workpiece 5 is not limited to bending in one and the same imaginary plane. Pivoting of forming head 3 about axis of rotation 17 between or during operations enables the central axis of the deformed portion of workpiece 5 to assume a three-dimensional shape.

Figure 6:
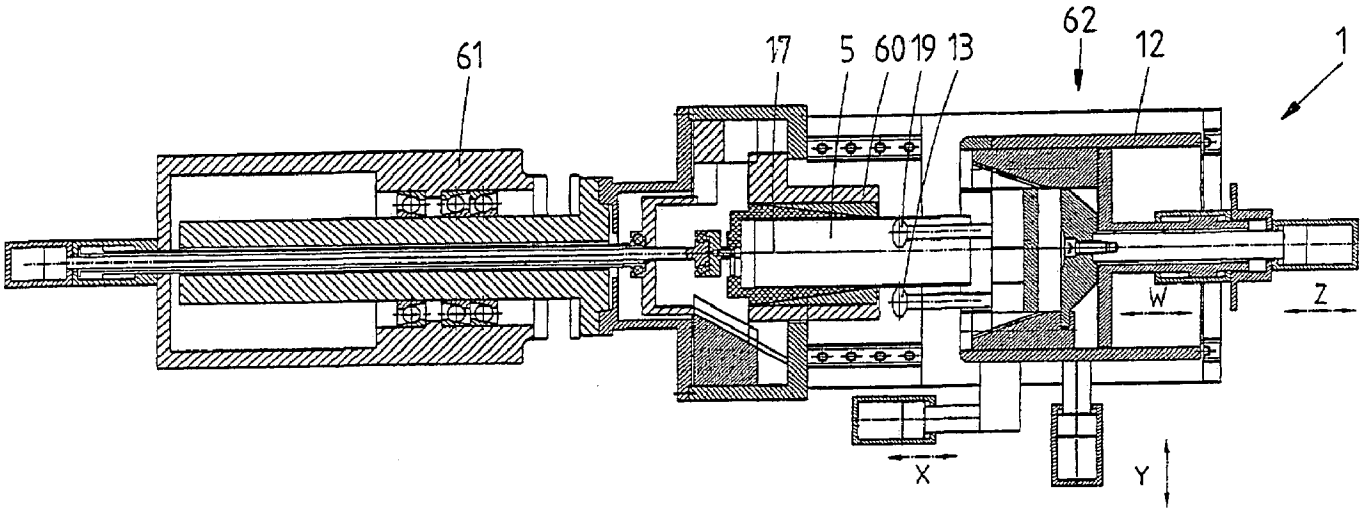
FIGS. 6 and 7 are schematic top plan views, partially in section, of a second embodiment of the forming machine according to the present invention comprising a single forming head and a rotatable workpiece.
Figure 7:
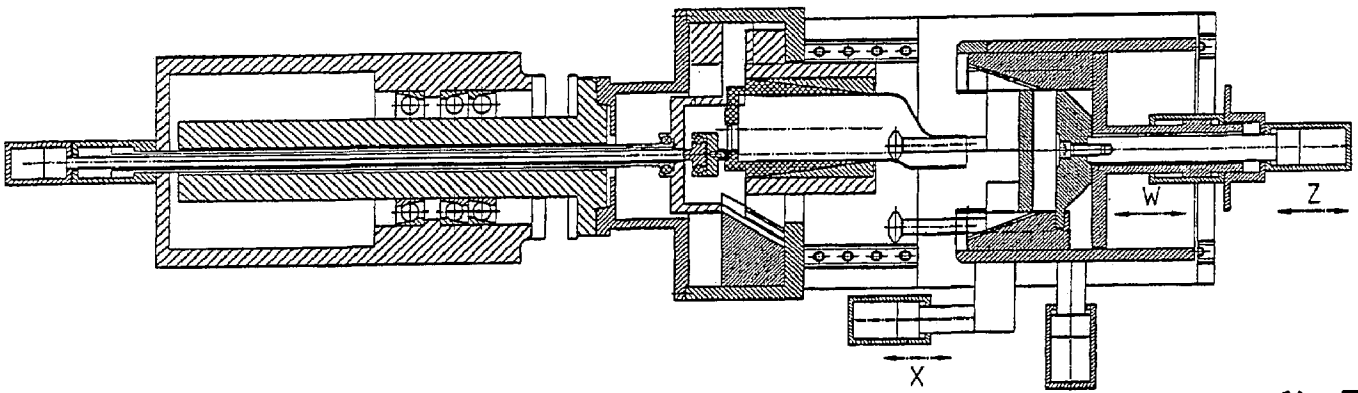
Figure 8:
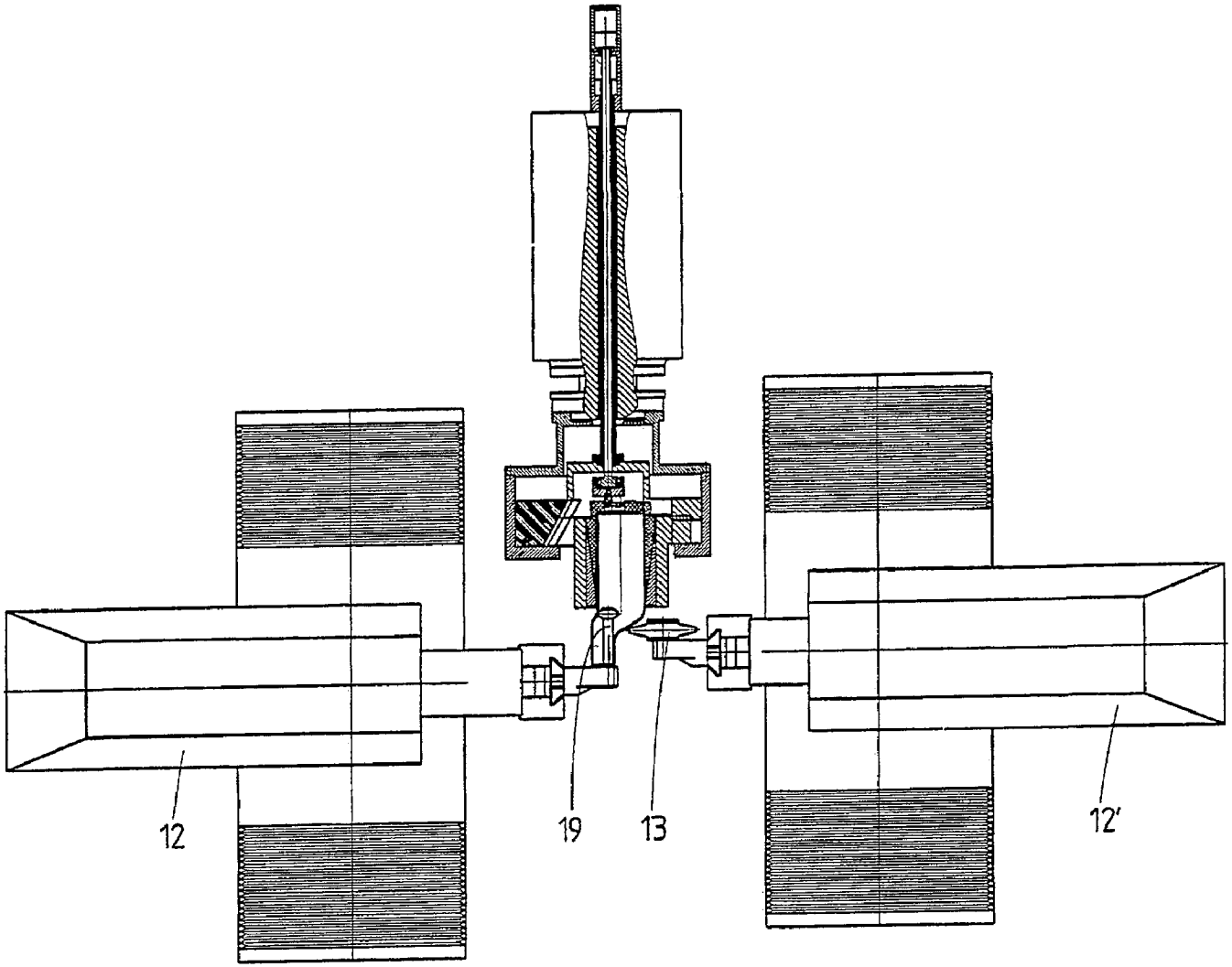
FIG. 8 is a schematic top plan view, partially in section, of a variant of the forming machine according to FIGS. 6 and 7.

FIGS. 6 and 7 show a second and relatively simple embodiment of the forming machine 1 according to the present invention, wherein workpiece 5 is clamped down, in a manner which is known per se, in a rotatable chuck 60 which is mounted in a spindle casing 61 and which can be rotated about an axis 17 by means of a drive such as an electric motor (not shown). A forming head 62 comprises an assembly 12, which is stationary and which need not be rotated, although driving means may be provided, of course, if an exceptionally high rotational speed of the assembly 12 relative to the workpiece 5 is desired. FIG. 8 shows a variant of the forming machine 1 according to FIGS. 6 and 7, wherein forming rollers 13 and inside roller 19 each form part of their own assembly 12, 12'. This makes it possible to control inside roller 19 fully independently of forming roller 13, which may be desirable for specific products.

Figure 9:
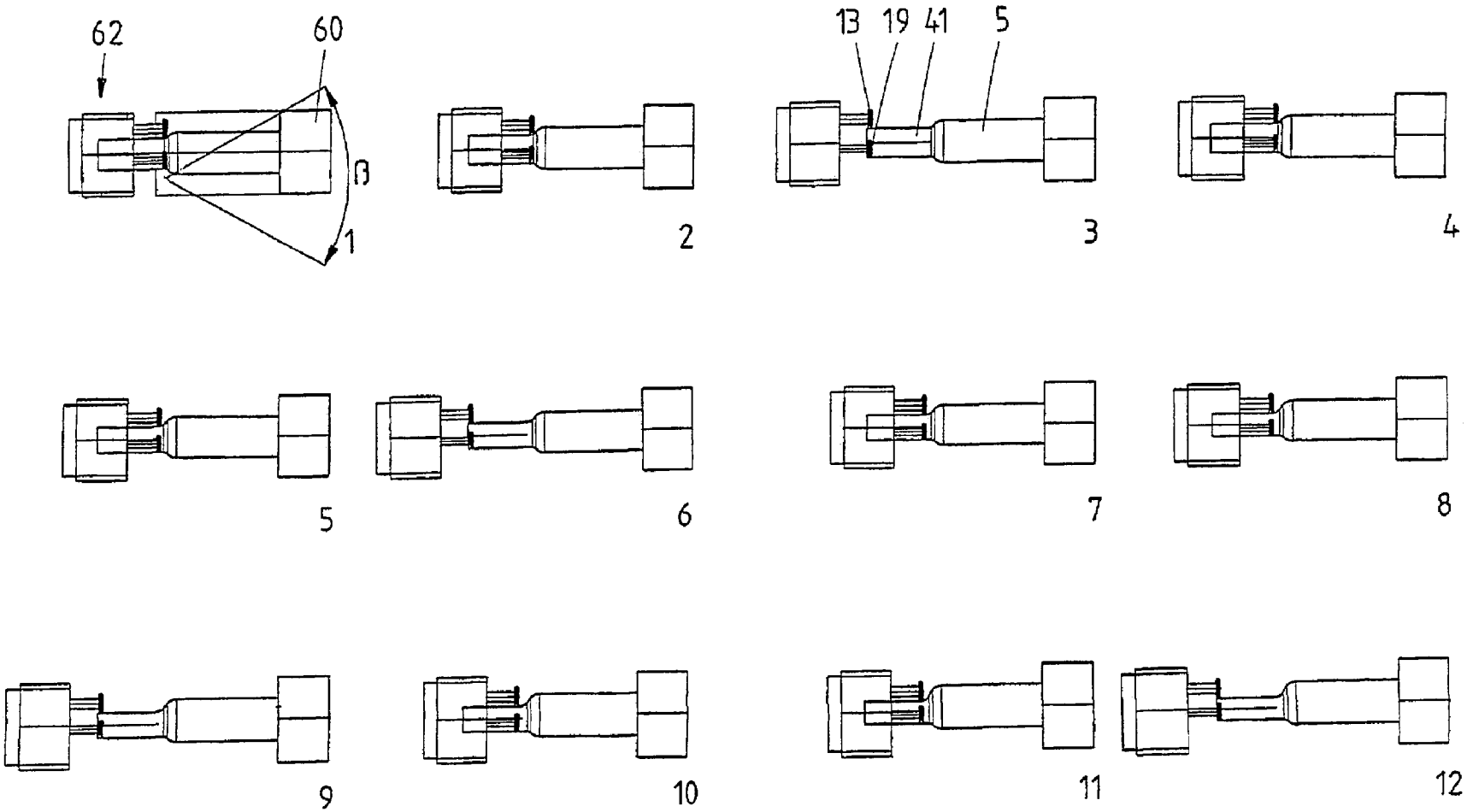
FIG. 9 shows a number of stages of a second method according to the present invention, carried out on the forming machine of FIGS. 6 and 7.

FIG. 9 schematically shows in 12 steps the manner in which an open end of a metal cylinder 5 can be deformed by means of forming head 62 of forming machine 1 according to FIGS. 6 and 7. Step 1 shows the starting position, wherein workpiece 5 is clamped down in a chuck 60. Said end, which has already undergone an operation and which has a smaller diameter than the other part of cylinder 5, is then (step 2) deformed by rotating chuck 60 and placing the forming rollers 13, 19 into contact with, respectively, the outer surface and the inner surface of cylinder 5 and moving said rollers radially towards axis of rotation 61 and away from axis of rotation 61, respectively (step 2), and subsequently adjusting assembly 12 a distance y in the Y-direction. Then the assembly 12 is translated in the X-direction is continued (step 3), so that an eccentric, cylindrical portion 41 remains, which portion has a smaller diameter than the original open end of cylinder 5 over a distance y. Then (step 4) the forming rollers 13, 19 are moved radially outwards and radially inwards, respectively, so that the contact between said rollers 13, 19 and, respectively, the outer surface and the inner surface of the wall of cylinder 5 is broken. Assembly 12 is moved back into cylindrical portion 41 in the X-direction, to the X-position in the starting position.

The above cycle is repeated by adjusting assembly 12 over a distance y (step 5, which is substantially identical to step 2) and translating assembly 12 in the X-direction (step 6, which is substantially identical to step 3), wherein the diameter of the cylindrical portion 41 is further reduced.

Depending on the characteristics of the workpiece, steps 2-4 are repeated until the desired reduction of the diameter and the eccentricity have been obtained, wherein the wall of the deformed portion may lie outside the circumference of the other part of the cylinder.

Figure 11:
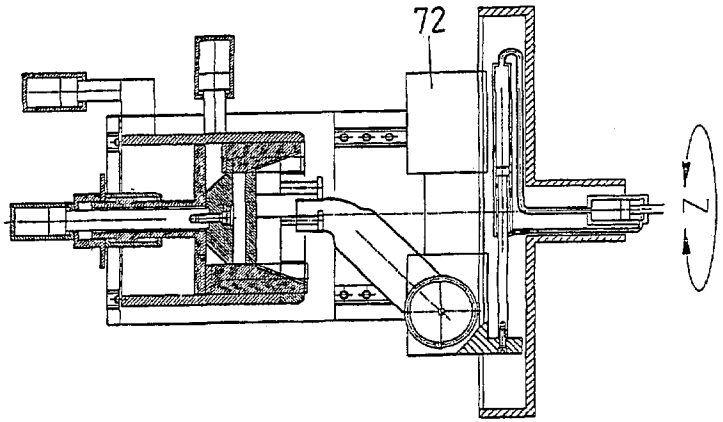
FIGS. 10, 11 and 12 are schematic top plan views, partially in section, of a fourth embodiment of the forming machine according to the present invention, by means of which the workpiece can be rotated.
Figure 12:
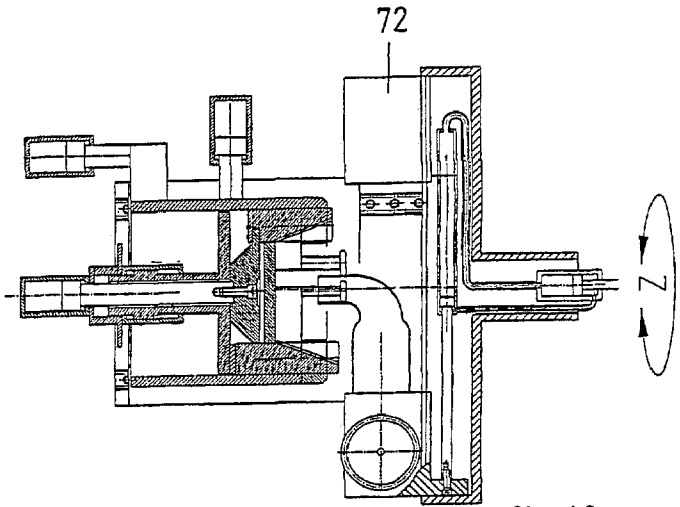
Figure 10:
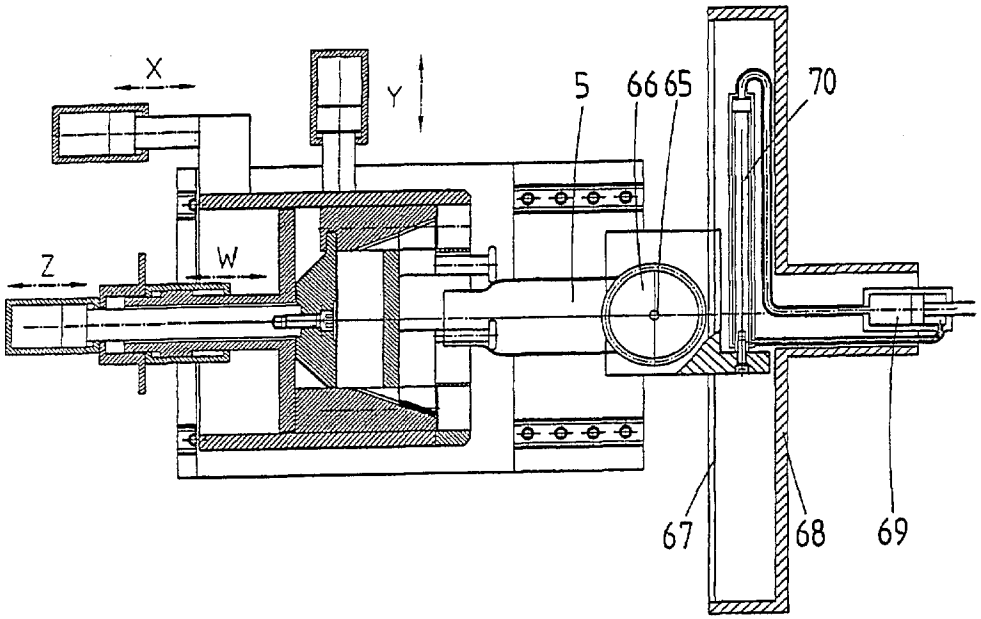

FIGS. 10-12 show a fourth embodiment of the forming machine 1 according to the present invention, wherein workpiece 5 is not only capable of being rotated, but also of being pivoted about a pivot point 65. To this end a chuck 66 is mounted in a slot 67 in a housing 68. Said housing 68 is rotatably mounted in a frame (not shown) and furthermore comprises hydraulic cylinders 69, 70 for radial adjustment of chuck 66, a gauge (not shown) for measuring the radial movement of chuck 66, a counterweight 72 for balancing the whole and a gauge (not shown) for measuring the pivoting of workpiece 5.

Figure 13:
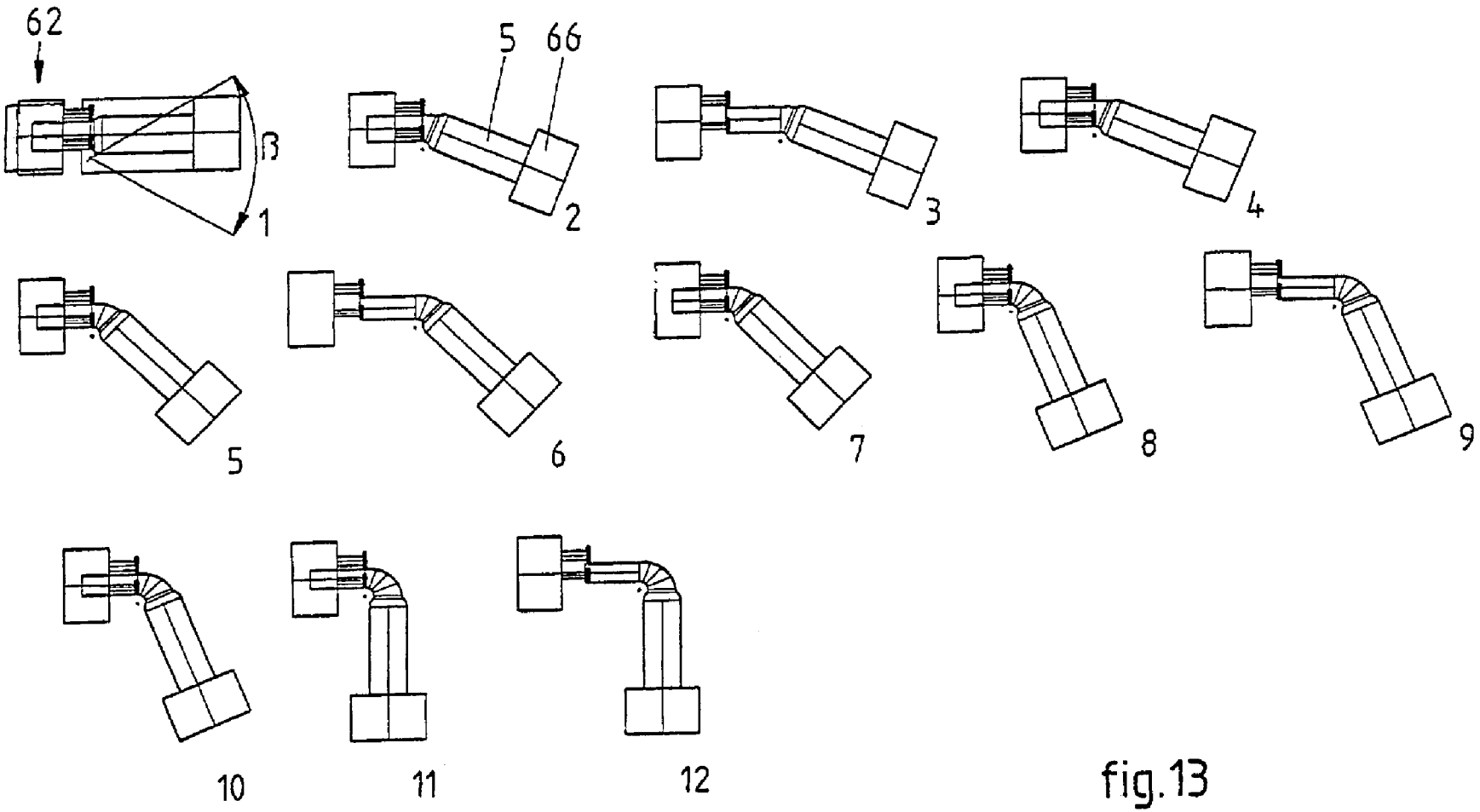
FIGS. 13 and 14 schematically show a number of stages of a second method according to the present invention, carried out on the forming machine of FIGS. 10-12.
Figure 14:
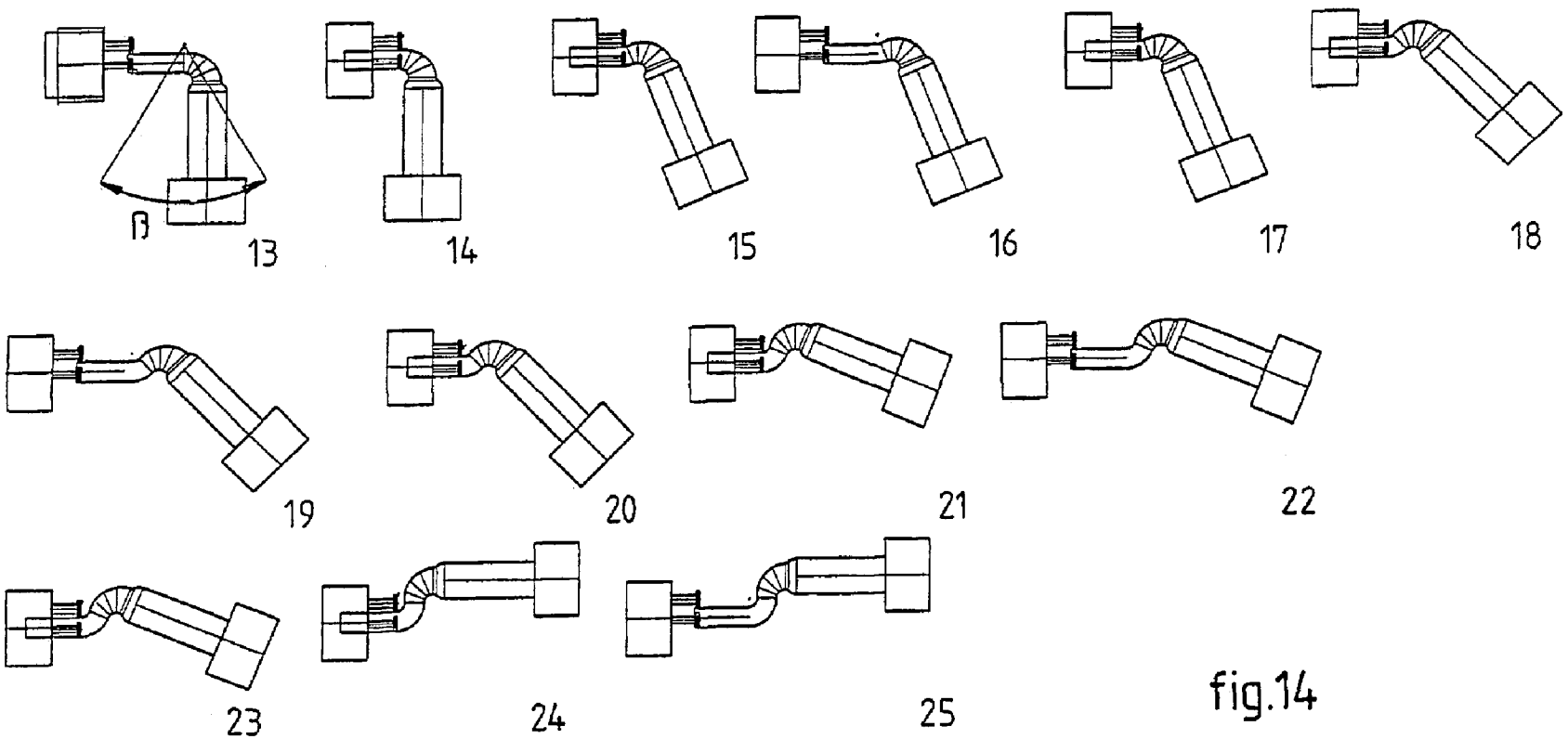

FIGS. 13 and 14 schematically show in 25 steps the manner in which an open end of a metal cylinder 5 can be deformed by means of forming head 3 of forming machine 1 according to FIG. 1. Step 1 shows the starting position, wherein workpiece 5 is clamped down in a chuck 4. Said steps are similar to the steps of FIGS. 4 and 5, wherein the movement of pivot point 37 is effected by moving assembly 12 in the X-direction and the Y-direction.

As a matter of course the forming machines according to the present invention can be operated by a person as well as by a control unit. Such a control unit is for example arranged for controlling the means for moving the rollers in X-direction, Y-direction and radial direction in accordance with a control program that is stored in a memory, in such a manner that the forming rollers follow one or more desired paths for deforming the workpiece into the desired product or intermediate product.

Although the invention has been explained on the basis of a cylindrical metal workpiece in the foregoing, it is also possible to implement the invention on workpieces of unround section, such as e.g. an oval, a substantially triangular or a multilobal section.

Consequently, the invention is not restricted to the above-described embodiments, which can be varied in several ways without departing from the scope of the invention as defined in the claims.

What is claimed is:

1. A method for deforming a hollow workpiece having at least one open end, wherein the workpiece is clamped down in a clamping device, a first forming tool is placed into contact with the outer surface of the workpiece, at least one of said workpiece and said first forming tool are rotated about an axis of rotation relative to each other and said first forming tool follows one or more desired paths with respect to the workpiece with a component parallel to the axis of rotation so as to work said workpiece; and wherein a second forming tool is placed into the cavity defined by the workpiece, and into contact with the inner surface of the hollow workpiece, and the workpiece is deformed beyond the end of the workpiece by means of said second forming tool.

2. The method according to claim 1, wherein said workpiece and said first and said second forming tools are rotated relative to each other about the axis of rotation which extends at least one of eccentrically and at an angle with a central axis of the clamped-down workpiece.

3. The method according to claim 1, wherein said first and second forming tools rotate in at least substantially the same plane during at least part of the operation.

4. The method according to claim 1, wherein the clamping device and said first and second forming tools are pivoted about at least one axis relative to each other during said deformation and/or between deforming steps on the same workpiece.

5. The method according to claim 4, wherein said clamping device and said first and second forming tools are pivoted about at least two axes relative to each other during said deformation and/or between deforming steps wherein at least two of said axes, or the projections of each of said axes on a common plane, are at an angle with respect to each other.

6. The method according to claim 5, wherein at least one of said axes is moved during said deformation and/or between deforming steps.

7. The method according to claim 1, wherein a larger part of the deforming is carried out in one flowing movement.

8. A forming machine comprising:

a clamping device for clamping down a hollow workpiece to be deformed, which has at least one open end;

a first forming tool being placeable into contact with the outer surface of the workpiece while the workpiece is being worked to cause deformation in an inward direction;

a driver configured to rotate at least one of said workpiece and said first forming tool relative to each other about an axis of rotation, such that said first forming tool is able to follow one or more desired paths with respect along the workpiece with a component parallel to the axis of rotation so as to work said workpiece; and at least one second forming tool, being insertable into the workpiece and placed into contact with an inner wall of the workpiece, such that said wall is deformed outwards.

9. The forming machine according to claim 8, wherein said driver is adapted to rotate said workpiece and said first and said second forming tools relative to each other, about an axis of rotation which extends at least one of eccentrically and at an angle with a central axis of the workpiece.

10. The forming machine according to claim 8, wherein said clamping device and said first and second forming tools are pivotable relative to each other about at least one axis.

11. The forming machine according to claim 10, wherein the clamping device and the first and second forming tools are pivotable about at least two axes, wherein at least two of said axes, or a projection of said axes on a common plane, are at an angle with respect to each other.

12. The forming machine according to claim 11, wherein at least one of said axes is movable.

13. The forming machine according to claim 8, wherein the clamping device for the workpiece is rotatable.

14. The forming machine according to claim 13, wherein a chuck for clamping down the workpiece is pivotally and translatably mounted in said clamping device.

15. The forming machine of claim 8 wherein the second forming tool is configured to deform the workpiece beyond the end of the workpiece.

16. A method for deforming a hollow workpiece having at least one open end, the method comprising:

clamping the workpiece in a clamping device;

engaging an outer surface of the workpiece with a first forming tool and working the workpiece, wherein said first forming tool follows one or more desired paths with respect to the workpiece with a component parallel to the axis of rotation so as to work said workpiece;

rotating at least one of said workpiece and said first forming tool about an axis of rotation relative to each other and; and engaging an inner surface of the workpiece with a second forming tool through the open end into a cavity of the workpiece and applying force with the second forming tool so as to deform the wall between the inner surface and the outer surface outwardly.

17. The method of claim 16 engaging the inner surface of the workpiece and applying force includes deform the workpiece beyond the open end of the workpiece.

18. The method according to claim 17 and further comprising rotating said first and said second forming tools relative to each other about the axis of rotation which extends at least one of eccentrically and at an angle with a central axis of the clamped-down workpiece.

19. The method according to claim 18, wherein said first and second forming tools rotate in at least substantially the same plane during at least part of the operation.

20. The method according to claim 18 and further comprising pivoting the clamping device and said first and second forming tools about at least one axis relative to each other during deformation of the workpiece and/or between deforming steps on the same workpiece.

* * * * *